US008637164B2

(12) United States Patent
Kobayashi et al.

(10) Patent No.: US 8,637,164 B2
(45) Date of Patent: Jan. 28, 2014

(54) SILVER-COATED COMPOSITE MATERIAL FOR A MOVABLE CONTACT PART, METHOD OF PRODUCING THE SAME, AND MOVABLE CONTACT PART

(75) Inventors: Yoshiaki Kobayashi, Tokyo (JP); Satoru Zama, Tokyo (JP); Satoshi Suzuki, Tokyo (JP); Masato Ohno, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 13/571,984

(22) Filed: Aug. 10, 2012

(65) Prior Publication Data

US 2012/0301745 A1 Nov. 29, 2012

Related U.S. Application Data

(63) Continuation of application No. PCT/JP2011/052911, filed on Feb. 10, 2011.

(30) Foreign Application Priority Data

Feb. 12, 2010 (JP) ..... 2010-028703

(51) Int. Cl.

| | |
|---|---|
| ***H01H 1/02*** | (2006.01) |
| ***C25D 5/26*** | (2006.01) |
| ***C25D 5/50*** | (2006.01) |
| ***C25D 7/00*** | (2006.01) |

(52) U.S. Cl.

USPC ..... 428/673; 428/685; 428/679; 428/675; 428/929; 148/518; 148/537; 427/125; 427/383.7; 205/181; 205/182; 205/224; 200/269

(58) Field of Classification Search

None

See application file for complete search history.

(56) References Cited

U.S. PATENT DOCUMENTS

| | | | | |
|---|---|---|---|---|
| 8,062,765 | B2 * | 11/2011 | Nakahara et al. | 428/673 |
| 2006/0188744 | A1 * | 8/2006 | Suzuki et al. | 428/673 |
| 2010/0233506 | A1 | 9/2010 | Tokuhara et al. | |

FOREIGN PATENT DOCUMENTS

| | | | |
|---|---|---|---|
| EP | 1690963 | * | 8/2006 |
| JP | 59-219945 | A | 12/1984 |
| JP | 63-137193 | A | 6/1988 |
| JP | 05-002940 | A | 1/1993 |
| JP | 8-283963 | * | 10/1996 |
| JP | 11-232950 | A | 8/1999 |

(Continued)

OTHER PUBLICATIONS

International Search Report for PCT/JP2011/052911 dated Mar. 8, 2011.

*Primary Examiner* — John J Zimmerman

(74) *Attorney, Agent, or Firm* — Birch, Stewart, Kolasch & Birch, LLP

(57) ABSTRACT

A silver-coated composite material for movable contact parts, which has: an underlying layer composed of any one of nickel, cobalt, a nickel alloy, and a cobalt alloy at least provided on a part of the surface of a stainless steel substrate; an intermediate layer composed of copper or a copper alloy provided thereon; and a silver or silver alloy layer provided thereon as an outermost layer, wherein a thickness of the intermediate layer is 0.05 to 0.3 μm, and wherein an average grain size of the silver or silver alloy provided as the outermost layer is 0.5 to 5.0 μm.

11 Claims, 2 Drawing Sheets

(56) References Cited

FOREIGN PATENT DOCUMENTS

| | | | | |
|---|---|---|---|---|
| JP | 2004-263274 | A | | 9/2004 |
| JP | 2005-002400 | A | | 1/2005 |
| JP | 2005-126763 | A | | 5/2005 |
| JP | 2005-133169 | A | | 5/2005 |
| JP | 2007-138237 | A | | 6/2007 |
| JP | 2007-254855 | A | | 10/2007 |
| JP | 2007-291510 | A | | 11/2007 |
| JP | 2008-088493 | A | | 4/2008 |
| JP | 2009-099550 | A | | 5/2009 |
| JP | 2009-215632 | A | | 9/2009 |
| WO | WO 2009/041481 | | * | 4/2009 |

* cited by examiner

SILVER-COATED COMPOSITE MATERIAL FOR A MOVABLE CONTACT PART, METHOD OF PRODUCING THE SAME, AND MOVABLE CONTACT PART

This application is a Bypass Continuation of PCT International Application No. PCT/JP2011/052911 filed on Feb. 10, 2011, which claims priority under 35 U.S.C. §119(a) to Patent Application No. 2010-028703 filed in Japan on Feb. 12, 2010. The entire contents of each of the above documents is hereby incorporated by reference into the present application.

TECHNICAL FIELD

The present invention relates to an electric contact part, and to a material of the same, and more specifically the present invention relates to a silver-coated composite material for a movable contact part that can be used at a movable contact in a small-sized switch to be used in electronic equipments, and to a movable contact part.

BACKGROUND ART

Disk spring contacts, brush contacts, and clip contacts have been mainly used for electric contacts, such as connectors, switches, and terminals. For parts of the contacts, use is made, in many cases, of a composite material for contacts, which is composed of a substrate, such as a copper alloy or stainless steel, which is excellent in corrosion resistance and mechanical properties, with the substrate being coated with silver, which is excellent in electrical characteristics and solderability.

Among the composite materials for contacts, those using stainless steel for the substrate are able to make contacts of small size, since they are excellent in mechanical characteristics and fatigue life, as compared with composite materials for contacts using a copper alloy for the substrate. Thus, the composite materials for contacts using stainless steel for the substrate are used for movable contacts, such as a tactile push switch and a sensing switch, that are required to have a long service life. In recent years, the composite materials are used, in many cases, for push buttons for mobile phones, in which the number of actions of such the switches is drastically increasing, due to diversification of email functions and Internet functions. Then, there is a demand for a movable contact part having a longer service life.

Since a composite material for contacts using stainless steel for the substrate allows size reduction of movable contact parts, as compared with a composite material for contacts using a copper alloy for the substrate, the size of switches can be reduced, and the number of actions thereof can be further increased. However, the contact pressure of such a switch becomes higher, resulting in a problem of a shortened contact service life, due to wear of the silver coated on the movable contact part.

For example, as a composite material for contacts obtained by coating a stainless steel strip with silver or a silver alloy, use is made, in many cases, of a composite material provided with nickel plating as an undercoat on the substrate (for example, see Patent Literature 1). However, when such a stainless steel strip is used for the switch, silver at the portion to be contacted is peeled off, due to wear as the number of actions of the switch increases. As a result, the nickel plating layer of an undercoat on the substrate is exposed to the air, which increases contact resistance, and failures ascribed to mal-continuity become evident. In particular, this phenomenon is liable to occur in dome-shaped movable contact parts having a small diameter, which has been a crucial technical problem for further reducing the size of the switch.

In order to solve this problem, there is proposed a composite material for contacts provided with nickel plating and palladium plating in this order on the substrate, and provided thereon with gold plating (see, for example, Patent Literature 2). However, since a coating of the palladium plating is hard or rigid, there is a problem that when the number of actions of the switch increases, cracks are apt to occur.

Further, there is proposed a composite material provided with nickel plating, copper plating, nickel plating, and gold plating, in this order on a stainless steel substrate, in order to improve electrical conductivity (see Patent Literature 3). However, although nickel plating itself is excellent in corrosion resistance, cracks occur in some cases at the nickel plating layer between the copper plating layer and the gold plating layer upon bending, due to the hardness of the nickel plating, to result in a problem of deterioration of corrosion resistance by making the copper plating layer expose to the air.

Further, as a technique in order to improve the contact service life, there is proposed a composite material provided with nickel plating, copper plating, and silver plating, in this order on a stainless steel substrate (see Patent Literatures 4 to 6). In those techniques, attempts have been made to improve the contact service life. As a result, when measuring the initial contact resistance value after a heat treatment (for example, for 5 minutes at a temperature of 260° C.) simulating soldering at the time of forming a contact module, and the contact resistance value after a heat treatment (for example, for one hour at a temperature of 200° C.) simulating a keystroke test, many of those were found to be at an inadequate level to be used as manufactured products, because the contact resistance values after the heat treatments were so high. This implies that when the materials are incorporated into manufactured products, the percent defective would become high. Thus, it is assumed that only by forming a nickel underlying layer, an intermediate copper layer, and a silver outermost layer, in this order at the respective predetermined thickness on a stainless steel substrate, the contact characteristics or contact service life after thermal hysteresis are unsatisfactory.

Further, as a technique in order to improve the contact service life, there is provided a material for electric contacts in which the surface of a strip material composed of copper or a copper alloy is coated with a layer composed of silver or a silver alloy, characterized in that the grain size of the silver or silver alloy is 5 μm or greater as the average value; and there is also disclosed a method of producing a material for electric contacts, characterized by including: forming a plating layer of silver or a silver alloy on the surface of a strip material composed of copper or a copper alloy, and then conducting a heat treatment at a temperature of 400° C. or higher under a non-oxidative gas atmosphere (Patent Literature 7). However, it is found that, when the composite material for contacts obtained by coating a stainless steel strip with silver or a silver alloy is subjected to the heat treatment at 400° C. or higher, in order to control the grain size of the silver or silver alloy to be 5 μm or greater, the spring characteristics of the stainless steel strip are deteriorated, and the composite material may not be applied as a material for movable contacts. Furthermore, nickel or cobalt, or a nickel alloy or a cobalt alloy is used in the intermediate layer, and a configuration in which a copper component is present in the intermediate layer as an upper layer of the underlying layer is not disclosed.

CITATION LIST

Patent Literatures

Patent Literature 1: JP-A-59-219945 ("JP-A" means unexamined published Japanese patent application)
Patent Literature 2: JP-A-11-232950
Patent Literature 3: JP-A-63-137193
Patent Literature 4: JP-A-2004-263274
Patent Literature 5: JP-A-2005-002400
Patent Literature 6: JP-A-2005-133169
Patent Literature 7: JP-A-5-002940

SUMMARY OF INVENTION

Technical Problem

Thus, the present invention is contemplated for providing a silver-coated composite material for movable contact parts, which is excellent in adhesiveness to plating even under repeated shear stress, which has a contact resistance value low and stable over a long time period, and which is improved in the service life when used in switches, and the present invention is also contemplated for providing a movable contact part using the same.

Solution to Problem

The inventors of the present invention, having studied keenly in view of the problems above, found that, in a silver-coated composite material for movable contact parts in which an underlying layer composed of any one of nickel, cobalt, a nickel alloy, and a cobalt alloy is at least formed on a part of the surface of a stainless steel substrate, an intermediate layer composed of copper or a copper alloy is formed thereon, and a silver or silver alloy layer is formed thereon as an outermost layer, when the average grain size of the silver or silver alloy formed in the outermost layer is set within the range of 0.5 to 5.0 μm, the contact resistance value is low even after thermal hysteresis, and the contact resistance can be maintained low and stable over a long time period. The inventors also found that when the thickness of the copper or copper alloy layer formed as the intermediate layer is set within the range of 0.05 to 0.3 μm, the effects of controlling the grain size is further enhanced. The present invention was attained based on those findings.

That is, according to the present invention, there is provided the following means:

(1) A silver-coated composite material for movable contact parts, which has: an underlying layer composed of any one of nickel, cobalt, a nickel alloy, and a cobalt alloy at least provided on a part of the surface of a stainless steel substrate; an intermediate layer composed of copper or a copper alloy provided thereon; and a silver or silver alloy layer provided thereon as an outermost layer, wherein a thickness of the intermediate layer is 0.05 to 0.3 μm, and wherein an average grain size of the silver or silver alloy provided as the outermost layer is 0.5 to 5.0 μm.

(2) The silver-coated composite material for movable contact parts as described in (1), wherein a thickness of the outermost layer is 0.3 to 2.0 μm.

(3) A method of producing a silver-coated composite material for movable contact parts, which comprises the steps of: providing an underlying layer composed of any one of nickel, cobalt, a nickel alloy, and a cobalt alloy at least on a part of the surface of a stainless steel substrate; providing an intermediate layer composed of copper or a copper alloy thereon; and providing a silver or silver alloy layer thereon as an outermost layer, wherein a thickness of the intermediate layer is 0.05 to 0.3 μm, and wherein an average grain size of the silver or silver alloy provided as the outermost layer is made to 0.5 to 5.0 μm, by conducting a heat treatment at a temperature within the range of 50 to 190° C. under an atmosphere of the air.

(4) The method of producing a silver-coated composite material for movable contact parts as described in (3), wherein the heat treatment is conducted at a temperature within the range of 50 to 100° C. for a time period of 0.1 to 12 hours.

(5) The method of producing a silver-coated composite material for movable contact parts as described in (3), wherein the heat treatment is conducted at a temperature within the range of higher than 100° C. but not higher than 190° C. for a time period of 0.01 to 5 hours.

(6) A method of producing a silver-coated composite material for movable contact parts, which comprises the steps of: providing an underlying layer composed of any one of nickel, cobalt, a nickel alloy, and a cobalt alloy at least on a part of the surface of a stainless steel substrate; providing an intermediate layer composed of copper or a copper alloy thereon; and providing a silver or silver alloy layer thereon as an outermost layer, wherein a thickness of the intermediate layer is 0.05 to 0.3 μm, and wherein an average grain size of the silver or silver alloy provided as the outermost layer is made to 0.5 to 5.0 μm, by conducting a heat treatment at a temperature within the range of 50 to 300° C. under a non-oxidative atmosphere.

(7) The method of producing a silver-coated composite material for movable contact parts as described in (6), wherein the heat treatment is conducted at a temperature within the range of 50 to 100° C. for a time period of 0.1 to 12 hours.

(8) The method of producing a silver-coated composite material for movable contact parts as described in (6), wherein the heat treatment is conducted at a temperature within the range of higher than 100° C. but not higher than 190° C. for a time period of 0.01 to 5 hours.

(9) The method of producing a silver-coated composite material for movable contact parts as described in (6), wherein the heat treatment is conducted at a temperature within the range of higher than 190° C. but not higher than 300° C. for a time period of 0.005 to 1 hour.

(10) A movable contact part, formed by working the silver-coated composite material for movable contact parts as described in (1) or (2), wherein a contact portion is formed into a dome shape or a convex (or protrusion) shape.

Advantageous Effects of Invention

According to the silver-coated composite material for movable contact parts of the present invention, the adhesive power of the silver coating layer is not decreased under repeated shear stress, as compared with conventional materials for movable contacts. Further, it is possible to provide a silver-coated composite material for movable contact parts capable of providing switches with further improved service life, since the contact resistance value is maintained low and stable over a long time period after thermal hysteresis in the case where the material is formed into a switch, or even after the switching action of the switch.

Furthermore, the movable contact part of the present invention is a product obtained by working the silver-coated composite material for movable contact parts, in which the occurrence of cracks in the layers after worked into a dome shape or a convex shape is suppressed. Thus, the contact resistance value is maintained low and stable for a long time period, and a movable contact part having a long contact service life is provided.

Other and further features and advantages of the invention will appear more fully from the following description, appropriately referring to the accompanying drawings.

BRIEF DESCRIPTION OF THE DRAWINGS

FIG. 2(*a*) shows the state before the switch action, and FIG. 2(*b*) shows the state at the time of the switch action.

MODE FOR CARRYING OUT THE INVENTION

Figure 1:
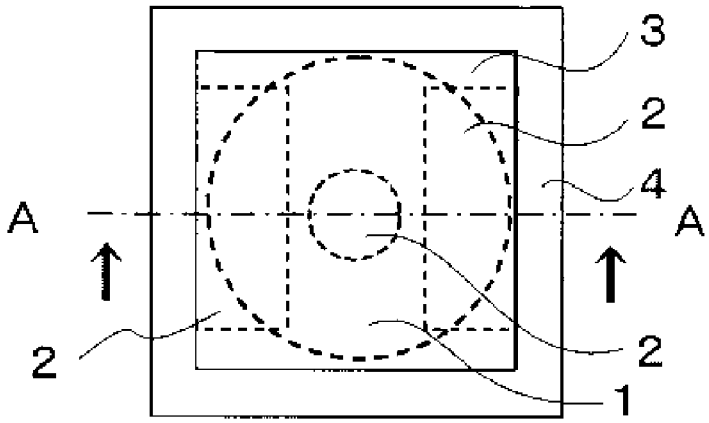
FIG. 1 is a plane view of a switch used for a keystroke test.

Preferred embodiments of the silver-coated composite material for movable contact parts and the movable contact part of the present invention, will be described in detail.

A basic embodiment of the present invention is a silver-coated composite material for movable contact parts, in which an underlying layer of nickel, cobalt, a nickel alloy, or a cobalt alloy, an intermediate layer of copper or a copper alloy, and an outermost layer of silver or a silver alloy with a controlled grain size, are provided, in this order, on at least a part of the surface of a stainless steel substrate. With respect to the movable contact part formed by the material above, contact resistance hardly increases even by increasing the number of actions of the switch.

In the embodiment of the present invention, the stainless steel substrate is responsible for mechanical strength, when used for the movable contact parts. Thus, as the stainless steel substrate, use can be made of any of tension annealed materials and tempered rolled materials, such as SUS 301, SUS 304, and SUS 316, each of which are excellent in stress relaxation resistance and hardly cause fatigue breakage.

The underlying layer formed on the stainless steel substrate is disposed, to enhance adhesivity between the stainless steel and the intermediate layer of copper or a copper alloy. The intermediate layer of copper or a copper alloy is a known technique having functions of capable of enhancing adhesivity between the underlying layer and the outermost layer, and capturing the oxygen that has diffused in the outermost layer, preventing oxidation of the component of the underlying layer, and thereby enhancing the adhesivity.

The metal for forming the underlying layer is selected, as known, from any one of nickel, cobalt, a nickel alloy, and a cobalt alloy, and nickel or cobalt is particularly preferable. The underlying layer is formed by electrolysis using the stainless steel substrate as a cathode and using an electrolyte solution containing, for example, nickel chloride and free hydrochloric acid. It is preferable to set the thickness of the thus-formed underlying layer to 0.005 to 2.0 μm, so as to make it difficult to cause cracking in the underlying layer at the time of press working, and it is more preferable to set the thickness to 0.01 to 0.2 μm.

Since the cause for lowering the adhesive force between the conventional outermost layer and the layer beneath thereof is oxidation of the underlying layer and a large shear stress repeatedly applied thereto, it was necessary, as countermeasures against those, to develop a material that satisfies two points of: one avoiding oxidation of the underlying layer; and the other not deteriorating its adhesivity even by applying the shear stress thereto.

Thus, in regard to the two tasks above, as a means for preventing oxidation of the underlying layer, which is the first task, the present invention is based on a configuration in which an intermediate layer composed of copper or a copper alloy is disposed. Oxidation of the underlying layer is caused by the permeation of oxygen in the outermost layer. When a copper or copper alloy layer is disposed, the copper component, which has diffused through the grain boundary of silver, captures oxygen in the outermost layer, to suppress oxidation of the underlying layer. By those actions, the intermediate layer also takes the role of preventing lowering in the adhesivity, which is the second task.

However, when the product of this configuration was used as a silver-coated stainless steel part for movable contacts, a problem occurred in which the contact resistance increased. The inventors of the present invention studied keenly on this problem, and found that this problem is caused by a phenomenon in which the copper component of the intermediate layer easily diffuses through the silver forming the outermost layer, and when the thus-diffused copper component reaches the surface of the outermost layer, the resultant copper component is oxidized to form copper oxide, thereby increasing the contact resistance.

When the grain size of the outermost layer composed of silver or a silver alloy in the present invention is controlled in the range of 0.5 to 5.0 μm, the amount of diffusion of the copper component formed at the intermediate layer can be suppressed. Thus, it is possible to provide excellent contact characteristics, and particularly, a silver-coated composite material for movable contact parts having satisfactory contact characteristics, by which the contact resistance is not increased even when subjected to thermal hysteresis, and by which the contact resistance does not increase even when used for a long time period as a movable contact part.

If the grain size is less than 0.5 μm, since there are many grain boundaries, the number of diffusion paths of the copper component of the intermediate layer increases. As a result, heat resistance reliability becomes insufficient, to cause a high possibility that the contact resistance may increase. On the contrary, if the grain size is greater than 5.0 μm, the effect is saturated, and also the hardness of the outermost layer is decreased, to make the outermost layer apt to be worn. Thus, the contact characteristics tend to lower, which is not preferable. As long as the grain size is within the prescribed range, the material can be preferably used. When the grain size is 0.75 to 2.0 μm, it is more preferable, because the composite material can have both long-term reliability and productivity.

For example, as Conventional Example 2 below, a test example simulating this is described herein. However, the grain size of the outermost layer composed of silver or a silver alloy in the conventional composite material for contacts, as described in Example 5 and the like of JP-A-2005-133169 (Patent Literature 6), is about 0.2 μm as an average grain size. As a result, it is assumed that there are many grain boundaries in the outermost layer, which are the paths of diffusion for the copper component of the intermediate layer or oxygen, and thereby the grain boundaries provide a major cause of lowering in the adhesivity between the layers or deterioration of the contact resistance.

Furthermore, as a method for adjusting the grain size of the silver or silver alloy forming the outermost layer, the grain size can be adjusted by appropriately controlling any of various conditions when silver is coated, by a method, for example, of a plating method, a cladding method, or a vapor deposition method. For example, in the case of an electroplating method, the grain size can be adjusted by controlling the additive(s) or surfactant(s) included in the plating liquid, the concentrations of various chemicals, the current density, the plating bath temperature, the stirring conditions, and the like. There are limitations when it is attempted to control the grain size based on those conditions, and in an industrially preferred range, the upper limit of the grain size is about 1.0 μm. In order to further enlarge the grain size, it is effective to perform a heat treatment, thereby to make the silver or silver alloy forming the outermost layer be recrystallized.

In the present invention, the thickness of the outermost layer and the grain size of the silver or silver alloy can be set, by appropriately controlling the plating conditions (particularly, current density) employed at the time of plating silver or a silver alloy as the outermost layer, and also, if necessary, appropriately controlling the heating conditions (particularly, the combination of the heating temperature and heating time period, with the atmosphere during heating) in the heat treatment after plating.

In general, when the current density is large, the grain size becomes small, and when the current density is small, the grain size becomes large. On the contrary, in the present invention, when the combination of the current density at the time of plating and the heat treatment conditions are controlled, the grain size can be appropriately controlled. Furthermore, when plating is carried out under the conditions of high current density, there is a tendency that the grain size may become large even under a heat treatment at a relatively low temperature. Thus, it is preferable to appropriately control the current density and the heat treatment conditions in combination.

The thickness of the intermediate layer according to the embodiment of the present invention is preferably in the range of 0.05 to 0.3 μm. If the thickness of the intermediate layer is less than 0.05 μm, it is insufficient to capture the oxygen component that has permeated through the outermost layer. On the contrary, if the intermediate layer is formed to be thicker than 0.3 μm, since the absolute amount of the copper component is large, even if the grain size of the silver or silver alloy forming the outermost layer is enlarged, the penetration of the copper component into the outermost layer may not be sufficiently suppressed. Thus, it is necessary that the thickness of the intermediate layer be 0.3 μm or less. When the thickness is in the prescribed range, satisfactory characteristics are sufficiently obtained, and a more effective range is 0.1 to 0.15 μm.

In the case of using a copper alloy to form the intermediate layer, a copper alloy containing one or two or more elements selected from tin, zinc, and nickel in a total amount of 1 to 10 mass % is preferred. There are no particular limitations on the component(s) to be used to form such an alloy with copper. However, the main component is copper, which captures oxygen that has permeated through the silver layer, and which enhances the adhesiveness to the underlying layer and the silver or silver alloy forming the outermost layer, and when another alloy element(s) is contained, the intermediate layer becomes hard, to enhance wear resistance. If the total amount of the said another element(s) is less than 1 mass %, the resultantly obtained effect is almost equal to the effect obtainable in the case where the intermediate layer is formed of pure copper. If the said total amount is greater than 10 mass %, the intermediate layer becomes too rigid, which may deteriorate the pressing property, or which may cause cracks upon the use as contacts, to deteriorate corrosion resistance, which is not preferable.

Furthermore, when the thickness of the outermost layer composed of silver or a silver alloy is set to 0.3 to 2.0 μm, more preferably 0.5 to 2.0 μm, and even more preferably 0.8 to 1.5 μm, the copper component substantially does not diffuse into the outermost layer even after heating, and the contact stability is excellent. If the thickness of the outermost layer is too thin, even if the grain size of the silver or silver alloy forming the outermost layer is controlled, since the copper component that has diffused from the intermediate layer can easily reach the surface layer, the contact resistance may be easily increased. On the contrary, if the thickness of the outermost layer is too thick, the effect is saturated, and also, since the amount to be used of silver is increased, it is not preferable from the viewpoints of economical efficiency and an increase in the environmental load.

Examples of silver or a silver alloy that can be preferably used as the outermost layer include silver, a silver-tin alloy, a silver-indium alloy, a silver-rhodium alloy, a silver-ruthenium alloy, a silver-gold alloy, a silver-palladium alloy, a silver-nickel alloy, a silver-selenium alloy, a silver-antimony alloy, a silver-copper alloy, a silver-zinc alloy, and a silver-bismuth alloy. In particular, it is preferable to select the silver or silver alloy from the group consisting of silver, a silver-tin alloy, a silver-indium alloy, a silver-rhodium alloy, a silver-ruthenium alloy, a silver-gold alloy, a silver-palladium alloy, a silver-nickel alloy, a silver-selenium alloy, a silver-antimony alloy, and a silver-copper alloy.

In the present invention, while each layer of the underlying layer, intermediate layer, and outermost layer may be formed by any method, such as an electroplating method, an electroless plating method, and a chemical/physical deposition method, the electroplating method is most advantageous from the viewpoints of productivity and costs. While each layer described above may be formed on the entire surface of the stainless steel substrate, it is economically advantageous to form the layer only on the contact region, which is preferable since products with a reduced environmental load can be provided.

Furthermore, as a method for enhancing the adhesive power and adjusting the grain size of the silver or silver alloy of the outermost layer, when a heating treatment under appropriate control is carried out, the grain size of the silver or silver alloy of the outermost layer can be adjusted to 0.5 to 5.0 μm by recrystallization, and the diffusion of the copper component of the intermediate layer and the silver component of the outermost layer can be caused to proceed, thereby enhancing the shear strength. The enhancement of the adhesive power can be realized when an alloy layer of silver and copper is formed. However, if the heating treatment is continued excessively, the diffusion of the copper component of the intermediate layer proceeds excessively so that the silver in the outermost layer may entirely turn into an alloy, or the copper component easily diffuses into the outermost layer, each of which causes an increase in the contact resistance. For this reason, an appropriate control of the atmosphere for the heating treatment or the heating temperature is necessary.

As preferred heat treatment conditions, in the case of performing the heat treatment under the atmosphere of the air, when the heat treatment is carried out at a temperature in the range of 50 to 190° C., recrystallization of the silver or silver alloy layer is accelerated, and thereby, a silver-copper alloy layer can be formed only in the vicinity of the interface so as to enhance the adhesive power. In this case, at a temperature below 50° C., recrystallization in a short time period is difficult, and on the contrary, when the temperature is above 190° C., the silver oxide covering the silver surface is decomposed into silver and oxygen. Then, the oxygen generated by the decomposition of silver oxide and a portion of oxygen in the air can easily form oxides with the copper component of the intermediate layer that has diffused into the outermost layer, and thereby, the contact resistance is apt to raise. Thus, it is appropriate to control the temperature in this range.

When the temperature is in the range described above, the intended state can be formed, and a more preferred range is from 100 to 150° C. In regard to the time period for heat treatment, since the time period taken by recrystallization varies with the plating texture of the silver or silver alloy forming the outermost layer, there are no limitations on the time period, and the heat treatment time period is determined from the viewpoint of preventing a lowering in productivity or preventing oxidation of the outermost layer component. For example, when the temperature is 50° C. or higher and 100° C. or lower, the time period is preferably in the range of 0.1 to 12 hours, and when the temperature is higher than 100° C. and not higher than 190° C., the time period is preferably in the range of 0.01 to 5 hours.

As other preferred treatment conditions, in the case of performing the heat treatment in a non-oxidative atmosphere, when the heat treatment is carried out at a temperature in the range of 50 to 300° C., recrystallization of the silver or silver alloy forming the outermost layer is accelerated, and a silver-copper alloy layer can be formed only in the vicinity of the interface of the intermediate layer and the outermost layer so as to enhance the adhesive power between those two layers. In this case, if the temperature is below 50° C., recrystallization in a short time period is difficult, and on the contrary, when the temperature is above 300° C., the copper component of the intermediate layer can diffuse more easily, and can easily reach the silver surface. Under a non-oxidative atmosphere, there is no chance for the copper component of the surface to be oxidized and thereby raise the contact resistance. However, if the copper component is exposed to the atmosphere of the air, the copper that has diffused into the outermost layer forms an oxide(s) simultaneously with the exposure, and raises the contact resistance, which is not preferable. Thus, it is appropriate to control the temperature in this range.

When the temperature is in the range described above, an intended state can be formed, but the temperature is more preferably 50 to 190° C., and even more preferably 100 to 150° C. Furthermore, in regard to the treatment time period, since the time period for recrystallization varies with the plating texture of the silver or silver alloy, there are no limitations, but the treatment time period is determined from the viewpoint of preventing a lowering in productivity or preventing the exposure of the copper component of the intermediate layer to the surface layer. For example, when the temperature is 50° C. or more and 100° C. or less, the treatment time period is preferably in the range of 0.1 to 12 hours; when the temperature is higher than 100° C. and not higher than 190° C., the treatment time period is preferably in the range of 0.01 to 5 hours; and when the temperature is higher than 190° C. and not higher than 300° C., the treatment time period is preferably in the range of 0.005 to 1 hour. While hydrogen, helium, argon, or nitrogen may be used as the non-oxidative atmosphere gas, argon is preferable to use from the viewpoints of availability, economic efficiency, and safety.

In the heating under a non-oxidative atmosphere, the effect of the decomposition of the silver oxide covering the silver surface of the outermost layer becomes small, as compared with the heating under the atmosphere of the air. However, if the heat treatment temperature exceeds 190° C., as the intermediate layer is heated, there is an increasing risk for the exposure of the copper component of the intermediate layer to the surface layer. Thus, it is preferable to set the heat treatment temperature to 190° C. or lower.

EXAMPLES

The present invention will be described in more detail based on examples given below, but the invention is not meant to be limited by these.

In a plating line to continuously fed a SUS substrate followed by winding, a substrate (a strip of SUS 301) with thickness 0.06 mm and strip width 100 mm was subjected to electrolytic degreasing, washing with water, activation, washing with water, underlying-layer plating, washing with water, intermediate-layer plating, washing with water, silver-strike plating, outermost-layer plating, washing with water, drying, and heat treatment, to obtain silver-coated stainless steel strips of Examples 1 to 53 according to the present invention, Comparative Examples 1 to 7, and Conventional Examples 1 to 3, each having the structure as shown in Table 1. In Examples 1 to 4 in which the grain size of the silver forming the outermost layer was adjusted only by the plating conditions, no heat treatment was carried out.

The treatment conditions are shown below.

1. (Electrolytic Degreasing, and Activation)

(Electrolytic Degreasing)

Treating liquid: sodium orthosilicate 100 g/L
Treating temperature: 60° C.
Cathode current density: 2.5 A/dm$^2$
Treating time period: 10 sec (Activation)

Treating liquid: aq. 10% hydrochloric acid
Treating temperature: 30° C.
Dipping time period: 10 sec 2. (Underlying-Layer Plating)

(Nickel Plating)

Treating liquid: nickel chloride 250 g/L, free hydrochloric acid 50 g/L
Treating temperature: 40° C.
Current density: 5 A/dm$^2$
Plating thickness: 0.01 to 0.2 μm
Treating time period: Adjusted for the respective plating thickness (Cobalt Plating)

Treating liquid: cobalt chloride 250 g/L, free hydrochloric acid 50 g/L
Treating temperature: 40° C.
Current density: 2 A/dm$^2$
Plating thickness: 0.01 μm
Treating time period: 2 sec 3. (Intermediate-Layer Plating)

(Copper Plating 1: Indicated as "Cu-1" in the Table)

Treating liquid: copper sulfate 150 g/L, free sulfuric acid 100 g/L, free hydrochloric acid 50 g/L
Treating temperature: 30° C.
Current density: 5 A/dm$^2$
Plating thickness: 0.05 to 0.3 μm
Treating time period: Adjusted for the respective plating thickness (Copper Plating 2: Indicated as "Cu-2" in the Table)

Figure 2:
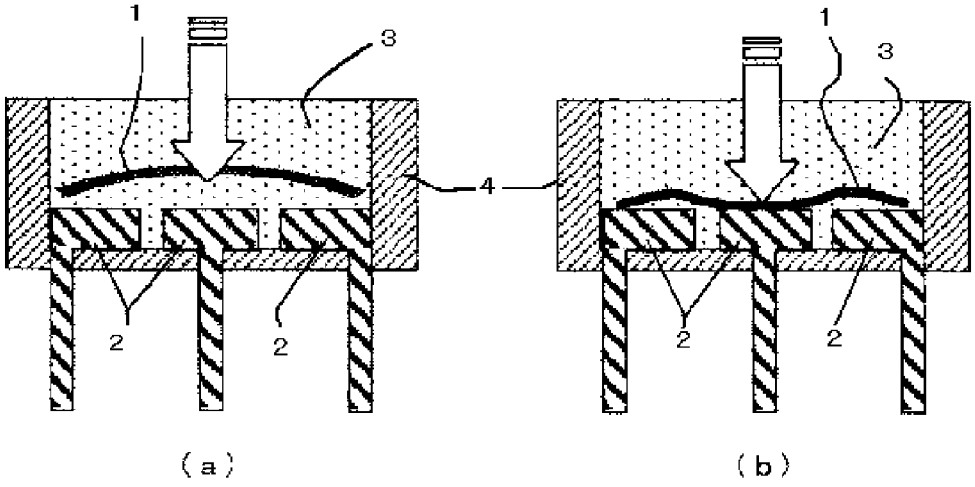
FIG. 2(*a*) and FIG. 2(*b*) each show a cross sectional view along the line A-A in the plane view of the switch used for the keystroke test and also show a compressed direction thereof.

Treating liquid: Copper(I) cyanide 30 g/L, free cyanide 10 g/L
Treating temperature: 40° C.
Current density: 5 A/dm$^2$
Plating thickness: 0.045 to 0.32 μm
Treating time period: Adjusted for the respective plating thickness 4. (Silver-Strike Plating)
   Treating liquid: silver cyanide 5 g/L, potassium cyanide 50 g/L
   Treating temperature: 30° C.
   Current density: 2 A/dm$^2$
   Treating time period: 10 sec
5. (Outermost-Layer Plating)
(Silver Plating)
   Treating liquid: silver cyanide 50 g/L, potassium cyanide 50 g/L, potassium carbonate 30 g/L, an additive (herein, sodium thiosulfate 0.5 g/L)
   Treating temperature: 40° C.
   Current density: Varied in the range of 0.05 to 15 A/dm$^2$, to adjust the grain size
   Plating thickness: 0.5 to 2.0 μm
   Treating time period: Adjusted for the respective plating thickness
(Silver-Tin Alloy Plating) Ag-10% Sn
   Treating liquid: potassium cyanide 100 g/L, sodium hydroxide 50 g/L, silver cyanide 10 g/L, potassium stannate 80 g/L, an additive (herein, sodium thiosulfate 0.5 g/L)
   Treating temperature: 40° C.
   Current density: 1 A/dm$^2$
   Plating thickness: 2.0 μm
   Treating time period: 3.2 min
(Silver-Indium Alloy Plating) Ag-10% In
   Treating liquid: potassium cyanide KCN100 g/L, sodium hydroxide 50 g/L, silver cyanide 10 g/L, indium chloride 20 g/L, an additive (herein, sodium thiosulfate 0.5 g/L)
   Treating temperature: 30° C.
   Current density: 2 A/dm$^2$
   Plating thickness: 2.0 μm
   Treating time period: 1.6 min The thus-obtained silver-coated composite materials for movable contact parts (i.e. silver-coated stainless steel strips) were worked into dome-shaped movable contact parts with diameter 4 mmϕ, respectively, to built-in a switch having the structure as shown in FIG. 1 and FIGS. 2(*a*) and 2(*b*). Then, the switches were subjected to a keystroke test, using, in fixed contacts, a brass strip having a plating layer of silver with thickness 1 μm. FIG. 1 is a plane view of the switch used for the keystroke test. FIGS. 2(*a*) and 2(*b*) are cross sectional views, along the line A-A in FIG. 1, of the switch used for the keystroke test, in which the pressing pressure is shown. FIG. 2(*a*) shows the state before pressing the switch, and FIG. 2(*b*) shows the state when pressing the switch. In the drawings, 1 denotes the dome-shaped movable contact of the silver-plated stainless steel; and 2 denotes the fixed contacts of the silver-plated brass. Those movable contacts and fixed contacts were built-in a resin case 4 with a resin filler 3.

With respect to the keystroke test, the keystrokes were carried out 1,000,000 times at maximum, with contact pressure 9.8 N/mm$^2$, at keystroke speed 5 Hz, to measure the change of the contact resistance with the lapse of time. The contact resistance was measured by passing an electric current of 10 mA, and the contact resistance value including fluctuation was evaluated by a four-grade system. Specifically, a contact resistance value of less than 15 mΩ was rated as "Excellent" and was indicated as "◎" in the table; a contact resistance value of not less than 15 mΩ and less than 20 mΩ was rated as "Good" and was indicated as "○" in the table; a contact resistance value of not less than 20 mΩ and less than 30 mΩ was rated as "Fair" and was indicated as "Δ" in the table; and a contact resistance value of more than 30 mΩ was rated as "Poor" and was indicated as "x" in the table. It was judged that contact resistance values of movable contacts of less than 30 mΩ, which are indicated as ◎, ○, and Δ, are practically useful as contacts.

Furthermore, whether copper component would be detected at the outermost layer or not, a qualitative analysis of the outermost layer was carried out with an Auger electron spectrometer, to determine the detected amount of the copper component. When no copper component was detected, the sample was indicated as "None"; when the detected amount was less than 5%, the sample was indicated as "Trace amount"; and when the detected amount was 5% or greater, the sample was indicated as "Large amount".

Furthermore, the movable contact side after the keystroke test was observed with the naked eye, to observe whether any peeling off of the plating was occurred or not, to determine whether peeling off was occurred or not.

The results of the above are shown in Table 2.

Furthermore, the measurement of the grain size of the silver or silver alloy of the outermost layer was conducted: by producing a vertical cross-section sample with a cross-section sample preparation device (Cross-Section Polisher: manufactured by JEOL, Ltd.), and then making an observation by Electron Backscatter Diffraction (EBSD). The results of the grain size thus measured are shown in Table 1, together with the other conditions.

TABLE 1

| | Underlying layer | | Intermediate layer | | Outermost layer | | | Heat treatment | | | |
|---|---|---|---|---|---|---|---|---|---|---|---|
| | Kind | Plating Thickness (μm) | Kind | Plating Thickness (μm) | Kind | Plating Thickness (μm) | Current density (A/dm$^2$) | Atmosphere | Temp. (° C.) | Time (hr) | Grain size (μm) |
| Ex 1 | Ni | 0.02 | Cu-1 | 0.1 | Ag | 1 | 0.1 | — | — | — | 0.5 |
| Ex 2 | Ni | 0.02 | Cu-1 | 0.1 | Ag | 1 | 0.05 | — | — | — | 1 |
| Ex 3 | Ni | 0.02 | Cu-1 | 0.1 | Ag | 1 | 0.025 | — | — | — | 2 |
| Ex 4 | Ni | 0.02 | Cu-1 | 0.1 | Ag | 1 | 0.01 | — | — | — | 5 |
| Ex 5 | Ni | 0.02 | Cu-1 | 0.1 | Ag | 1 | 10 | in the air | 130 | 0.01 | 0.5 |
| Ex 6 | Ni | 0.02 | Cu-1 | 0.1 | Ag | 1 | 10 | in the air | 180 | 0.5 | 0.75 |
| Ex 7 | Ni | 0.02 | Cu-1 | 0.1 | Ag | 1 | 10 | Ar | 200 | 0.25 | 1 |
| Ex 8 | Ni | 0.02 | Cu-1 | 0.1 | Ag | 1 | 10 | Ar | 250 | 0.75 | 3 |
| Ex 9 | Ni | 0.02 | Cu-1 | 0.1 | Ag | 1 | 10 | Ar | 300 | 1 | 5 |
| Ex 10 | Ni | 0.01 | Cu-2 | 0.05 | Ag | 1 | 10 | in the air | 180 | 0.5 | 0.75 |
| Ex 11 | Ni | 0.01 | Cu-2 | 0.09 | Ag | 1 | 10 | in the air | 180 | 0.5 | 0.75 |
| Ex 12 | Ni | 0.01 | Cu-2 | 0.12 | Ag | 1 | 10 | in the air | 180 | 0.5 | 0.75 |
| Ex 13 | Ni | 0.01 | Cu-2 | 0.15 | Ag | 1 | 10 | in the air | 180 | 0.5 | 0.75 |
| Ex 14 | Ni | 0.01 | Cu-2 | 0.18 | Ag | 1 | 10 | in the air | 180 | 0.5 | 0.75 |

TABLE 1-continued

| | Underlying layer | | Intermediate layer | | Outermost layer | | | Heat treatment | | | |
|---|---|---|---|---|---|---|---|---|---|---|---|
| | Kind | Plating Thickness (μm) | Kind | Plating Thickness (μm) | Kind | Plating Thickness (μm) | Current density (A/dm$^2$) | Atmosphere | Temp. (° C.) | Time (hr) | Grain size (μm) |
| Ex 15 | Ni | 0.01 | Cu-2 | 0.3 | Ag | 1 | 10 | in the air | 180 | 0.5 | 0.75 |
| Ex 16 | Co | 0.01 | Cu-1 | 0.12 | Ag | 0.5 | 10 | in the air | 180 | 0.5 | 0.75 |
| Ex 17 | Co | 0.01 | Cu-1 | 0.12 | Ag | 0.75 | 10 | in the air | 180 | 0.5 | 0.75 |
| Ex 18 | Co | 0.01 | Cu-1 | 0.12 | Ag | 0.82 | 10 | in the air | 180 | 0.5 | 0.75 |
| Ex 19 | Co | 0.01 | Cu-1 | 0.12 | Ag | 1 | 10 | in the air | 180 | 0.5 | 0.75 |
| Ex 20 | Co | 0.01 | Cu-1 | 0.12 | Ag | 1.48 | 10 | in the air | 180 | 0.5 | 0.75 |
| Ex 21 | Co | 0.01 | Cu-1 | 0.12 | Ag | 1.67 | 10 | in the air | 180 | 0.5 | 0.75 |
| Ex 22 | Co | 0.01 | Cu-1 | 0.12 | Ag | 2 | 10 | in the air | 180 | 0.5 | 0.75 |
| Ex 23 | Co | 0.01 | Cu-1 | 0.12 | Ag—Sn | 1 | 1 | in the air | 180 | 0.25 | 0.6 |
| Ex 24 | Co | 0.01 | Cu-1 | 0.12 | Ag—In | 1 | 2 | in the air | 180 | 0.25 | 0.7 |
| Ex 25 | Co | 0.01 | Cu-1 | 0.12 | Ag—Sn | 1 | 1 | Ar | 180 | 0.25 | 0.6 |
| Ex 26 | Co | 0.01 | Cu-1 | 0.12 | Ag—In | 1 | 2 | Ar | 180 | 0.25 | 0.7 |
| Ex 27 | Co | 0.01 | Cu-1 | 0.12 | Ag—Sn | 1 | 1 | Ar | 200 | 0.25 | 0.75 |
| Ex 28 | Co | 0.01 | Cu-1 | 0.12 | Ag—In | 1 | 2 | Ar | 200 | 0.25 | 0.8 |
| Ex 29 | Ni | 0.2 | Cu-2 | 0.05 | Ag | 0.5 | 15 | in the air | 50 | 0.1 | 0.5 |
| Ex 30 | Ni | 0.2 | Cu-2 | 0.05 | Ag | 2 | 10 | in the air | 50 | 0.75 | 0.5 |
| Ex 31 | Ni | 0.2 | Cu-2 | 0.3 | Ag | 0.5 | 15 | in the air | 50 | 0.1 | 0.5 |
| Ex 32 | Ni | 0.2 | Cu-2 | 0.3 | Ag | 2 | 10 | in the air | 50 | 0.75 | 0.5 |
| Ex 33 | Ni | 0.015 | Cu-1 | 0.13 | Ag | 1 | 10 | in the air | 50 | 1 | 0.8 |
| Ex 34 | Ni | 0.015 | Cu-1 | 0.13 | Ag | 1 | 10 | in the air | 100 | 1 | 1.2 |
| Ex 35 | Ni | 0.015 | Cu-1 | 0.13 | Ag | 1 | 10 | in the air | 150 | 1 | 1.6 |
| Ex 36 | Ni | 0.015 | Cu-1 | 0.13 | Ag | 1 | 10 | in the air | 185 | 1 | 2 |
| Ex 37 | Ni | 0.015 | Cu-1 | 0.13 | Ag | 1 | 10 | in the air | 100 | 0.25 | 0.7 |
| Ex 38 | Ni | 0.015 | Cu-1 | 0.13 | Ag | 1 | 10 | in the air | 100 | 4 | 2 |
| Ex 39 | Ni | 0.015 | Cu-1 | 0.13 | Ag | 1 | 10 | in the air | 100 | 12 | 4.8 |
| Ex 40 | Ni | 0.015 | Cu-1 | 0.13 | Ag | 1 | 10 | Ar | 50 | 1 | 0.8 |
| Ex 41 | Ni | 0.015 | Cu-1 | 0.13 | Ag | 1 | 10 | Ar | 100 | 1 | 1.2 |
| Ex 42 | Ni | 0.015 | Cu-1 | 0.13 | Ag | 1 | 10 | Ar | 150 | 1 | 1.6 |
| Ex 43 | Ni | 0.015 | Cu-1 | 0.13 | Ag | 1 | 10 | Ar | 180 | 1 | 2 |
| Ex 44 | Ni | 0.015 | Cu-1 | 0.13 | Ag | 1 | 10 | Ar | 200 | 1 | 2.3 |
| Ex 45 | Ni | 0.015 | Cu-1 | 0.13 | Ag | 1 | 10 | Ar | 90 | 0.1 | 0.7 |
| Ex 46 | Ni | 0.015 | Cu-1 | 0.13 | Ag | 1 | 10 | Ar | 90 | 1 | 1 |
| Ex 47 | Ni | 0.015 | Cu-1 | 0.13 | Ag | 1 | 10 | Ar | 90 | 12 | 4.7 |
| Ex 48 | Ni | 0.015 | Cu-1 | 0.13 | Ag | 1 | 10 | Ar | 180 | 0.01 | 0.5 |
| Ex 49 | Ni | 0.015 | Cu-1 | 0.13 | Ag | 1 | 10 | Ar | 180 | 0.5 | 1 |
| Ex 50 | Ni | 0.015 | Cu-1 | 0.13 | Ag | 1 | 10 | Ar | 180 | 5 | 4.8 |
| Ex 51 | Ni | 0.015 | Cu-1 | 0.13 | Ag | 1 | 10 | Ar | 250 | 0.008 | 0.6 |
| Ex 52 | Ni | 0.015 | Cu-1 | 0.13 | Ag | 1 | 10 | Ar | 250 | 0.5 | 2 |
| Ex 53 | Ni | 0.015 | Cu-1 | 0.13 | Ag | 1 | 10 | Ar | 250 | 0.75 | 3 |
| C Ex 1 | Ni | 0.2 | Cu-2 | 0.12 | Ag | 1 | 1 | — | — | — | 0.2 |
| C Ex 2 | Ni | 0.2 | Cu-2 | 0.045 | Ag | 2 | 10 | in the air | 180 | 0.5 | 0.75 |
| C Ex 3 | Ni | 0.2 | Cu-2 | 0.32 | Ag | 2 | 10 | in the air | 180 | 0.5 | 0.75 |
| C Ex 4 | Ni | 0.2 | Cu-2 | 0.15 | Ag | 2 | 10 | in the air | 40 | 1 | 0.45 |
| C Ex 5 | Ni | 0.2 | Cu-2 | 0.15 | Ag | 1 | 10 | Ar | 40 | 1 | 0.45 |
| C Ex 6 | Ni | 0.015 | Cu-1 | 0.13 | Ag | 1 | 10 | Ar | 320 | 1 | 5.3 |
| C Ex 7 | Ni | 0.015 | Cu-1 | 0.13 | Ag | 1 | 15 | Ar | 300 | 2 | 6.5 |
| Conv Ex 1 | Ni | 0.5 | — | — | Ag | 0.5 | 1 | Ar | 700 | 0.003 | 7 |
| Conv Ex 2 | Ni | 0.05 | Cu-1 | 0.05 | Ag | 1 | 5 | — | — | — | 0.2 |
| Conv Ex 3 | Ni | 0.05 | Cu-1 | 0.05 | Ag | 1 | 5 | Ar | 250 | 2 | 5.5 |

"Ex" means Example according to the present invention
"C Ex" means Comparative Example
"Conv Ex" means Conventional Example

TABLE 2

| | Contact resistance | | | | | | | |
|---|---|---|---|---|---|---|---|---|
| | Initial | 10,000 times | 50,000 times | 100,000 times | 500,000 times | 1,000,000 times | Detection of copper component | Peeling off |
| Ex 1 | ◎ | ◎ | ◎ | ◎ | ○ | Δ | Trace amount | None |
| Ex 2 | ◎ | ◎ | ◎ | ◎ | ◎ | ○ | None | None |
| Ex 3 | ◎ | ◎ | ◎ | ◎ | ◎ | ◎ | None | None |
| Ex 4 | ◎ | ◎ | ◎ | ◎ | ◎ | ○ | None | None |
| Ex 5 | ◎ | ◎ | ◎ | ◎ | ◎ | ○ | None | None |
| Ex 6 | ◎ | ◎ | ◎ | ◎ | ◎ | ◎ | None | None |
| Ex 7 | ◎ | ◎ | ◎ | ◎ | ◎ | ◎ | None | None |
| Ex 8 | ◎ | ◎ | ◎ | ◎ | ◎ | ◎ | None | None |
| Ex 9 | ◎ | ◎ | ◎ | ◎ | ○ | Δ | Trace amount | None |

TABLE 2-continued

| | Contact resistance | | | | | | | |
|---|---|---|---|---|---|---|---|---|
| | Initial | 10,000 times | 50,000 times | 100,000 times | 500,000 times | 1,000,000 times | Detection of copper component | Peeling off |
| Ex 10 | ◎ | ◎ | ◎ | ◎ | ○ | Δ | None | None |
| Ex 11 | ◎ | ◎ | ◎ | ◎ | ◎ | ○ | None | None |
| Ex 12 | ◎ | ◎ | ◎ | ◎ | ◎ | ◎ | None | None |
| Ex 13 | ◎ | ◎ | ◎ | ◎ | ◎ | ◎ | None | None |
| Ex 14 | ◎ | ◎ | ◎ | ◎ | ◎ | ○ | None | None |
| Ex 15 | ◎ | ◎ | ◎ | ◎ | ○ | Δ | Trace amount | None |
| Ex 16 | ◎ | ◎ | ◎ | ◎ | ○ | Δ | Trace amount | None |
| Ex 17 | ◎ | ◎ | ◎ | ◎ | ◎ | ○ | None | None |
| Ex 18 | ◎ | ◎ | ◎ | ◎ | ◎ | ◎ | None | None |
| Ex 19 | ◎ | ◎ | ◎ | ◎ | ◎ | ◎ | None | None |
| Ex 20 | ◎ | ◎ | ◎ | ◎ | ◎ | ◎ | None | None |
| Ex 21 | ◎ | ◎ | ◎ | ◎ | ◎ | ◎ | None | None |
| Ex 22 | ◎ | ◎ | ◎ | ◎ | ◎ | ◎ | None | None |
| Ex 23 | ◎ | ◎ | ◎ | ◎ | ◎ | ◎ | None | None |
| Ex 24 | ◎ | ◎ | ◎ | ◎ | ◎ | ◎ | None | None |
| Ex 25 | ◎ | ◎ | ◎ | ◎ | ◎ | ◎ | None | None |
| Ex 26 | ◎ | ◎ | ◎ | ◎ | ◎ | ◎ | None | None |
| Ex 27 | ◎ | ◎ | ◎ | ◎ | ◎ | ◎ | None | None |
| Ex 28 | ◎ | ◎ | ◎ | ◎ | ◎ | ◎ | None | None |
| Ex 29 | ◎ | ◎ | ◎ | ◎ | ○ | Δ | Trace amount | None |
| Ex 30 | ◎ | ◎ | ◎ | ◎ | ◎ | ◎ | None | None |
| Ex 31 | ◎ | ◎ | ◎ | ◎ | ○ | Δ | Trace amount | None |
| Ex 32 | ◎ | ◎ | ◎ | ◎ | ◎ | ◎ | None | None |
| Ex 33 | ◎ | ◎ | ◎ | ◎ | ◎ | ◎ | None | None |
| Ex 34 | ◎ | ◎ | ◎ | ◎ | ◎ | ◎ | None | None |
| Ex 35 | ◎ | ◎ | ◎ | ◎ | ◎ | ◎ | None | None |
| Ex 36 | ◎ | ◎ | ◎ | ◎ | ◎ | ○ | Trace amount | None |
| Ex 37 | ◎ | ◎ | ◎ | ◎ | ◎ | ◎ | None | None |
| Ex 38 | ◎ | ◎ | ◎ | ◎ | ◎ | ○ | Trace amount | None |
| Ex 39 | ◎ | ◎ | ◎ | ◎ | ○ | Δ | Trace amount | None |
| Ex 40 | ◎ | ◎ | ◎ | ◎ | ◎ | ◎ | None | None |
| Ex 41 | ◎ | ◎ | ◎ | ◎ | ◎ | ◎ | None | None |
| Ex 42 | ◎ | ◎ | ◎ | ◎ | ◎ | ◎ | None | None |
| Ex 43 | ◎ | ◎ | ◎ | ◎ | ◎ | ◎ | None | None |
| Ex 44 | ◎ | ◎ | ◎ | ◎ | ◎ | ○ | Trace amount | None |
| Ex 45 | ◎ | ◎ | ◎ | ◎ | ◎ | ◎ | None | None |
| Ex 46 | ◎ | ◎ | ◎ | ◎ | ◎ | ◎ | None | None |
| Ex 47 | ◎ | ◎ | ◎ | ◎ | ○ | Δ | Trace amount | None |
| Ex 48 | ◎ | ◎ | ◎ | ◎ | ◎ | ◎ | None | None |
| Ex 49 | ◎ | ◎ | ◎ | ◎ | ◎ | ◎ | None | None |
| Ex 50 | ◎ | ◎ | ◎ | ◎ | ○ | Δ | Trace amount | None |
| Ex 51 | ◎ | ◎ | ◎ | ◎ | ◎ | ◎ | None | None |
| Ex 52 | ◎ | ◎ | ◎ | ◎ | ◎ | ○ | Trace amount | None |
| Ex 53 | ◎ | ◎ | ◎ | ◎ | ◎ | ○ | Trace amount | None |
| C Ex 1 | ◎ | ◎ | ○ | ○ | X | X | Large amount | None |
| C Ex 2 | ◎ | ◎ | ◎ | ○ | Δ | X | Trace amount | Peeled off |
| C Ex 3 | ◎ | ◎ | ◎ | ○ | Δ | X | Large amount | None |
| C Ex 4 | ◎ | ◎ | ○ | ○ | Δ | X | Large amount | None |
| C Ex 5 | ◎ | ◎ | ◎ | ○ | Δ | X | Large amount | None |
| C Ex 6 | ◎ | ◎ | ◎ | ○ | Δ | X | Large amount | None |
| C Ex 7 | ◎ | ◎ | ○ | ○ | Δ | X | Large amount | None |
| Conv Ex 1 | ◎ | ○ | ○ | Δ | X | X | None | Peeled off |
| Conv Ex 2 | ◎ | ◎ | ◎ | ○ | Δ | X | Trace amount | None |
| Conv Ex 3 | ○ | ○ | ○ | ○ | Δ | X | Large amount | None |

According to the silver-coated composite materials for movable contact parts of Examples 1 to 53 according to the present invention, the increment of the contact resistance was less than 30 mΩ in all cases, even when the keystroke test of one million times was carried out after worked into movable contacts.

Contrary to the above, in Comparative Examples 1 to 7, the contact resistance increased to 30 mΩ or greater after the keystrokes of one million times, and it is found that the contact service life is short.

Furthermore, Comparative Example 1 is a conventional example, in which nickel plating was provided as the underlying layer, copper plating as the intermediate layer, and silver plating as the outermost layer, and in which the grain size of silver of the outermost layer was about 0.2 μm, and the contact resistance began to increase after 10,000 keystrokes, and increased to 30 mΩ or greater after 50,000 keystrokes. Thus, it can be seen that there is a problem in practical use of the material of Comparative Example 1.

Figure 3:
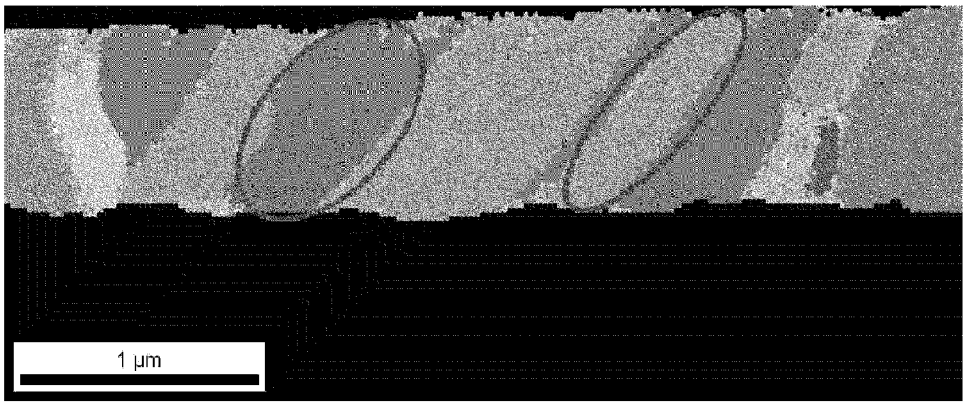
FIG. 3 is a photograph of the cross section of the silver-coated composite material for movable contact parts of the present invention, illustrating an example in which the average grain size was about 0.75 μm.
Figure 4:
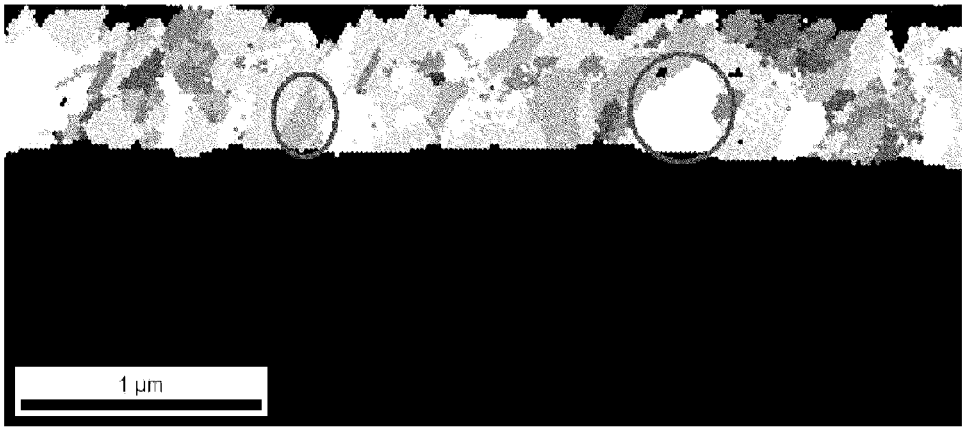
FIG. 4 is a photograph of the cross section of a conventional silver-coated composite material for movable contact parts, illustrating an example in which the average grain size was about 0.2 μm.

FIG. 3 shows a photograph taken by observing Example 4 by EBSD, and FIG. 4 shows a photograph taken by observing Comparative Example 1 by EBSD. In FIGS. 3 and 4, for example, the regions indicated by marking on the photographs represent a single grain, respectively. The grain size of silver of the outermost layer in Example 4 of FIG. 3 was about 0.75 μm, while the grain size of silver of the outermost layer in Comparative Example 1 of FIG. 4 was about 0.2 μm. From the comparison of those, it is understood that a satisfactory value of contact resistance can be obtained, by appropriately controlling the grain size of silver of the outermost layer.

In Comparative Example 2, in which the intermediate layer composed of copper was thin, peeling off occurred between the outermost layer and the intermediate layer after one million keystrokes, and the capture of oxygen that had permeated occurred insufficiently, to result in poor adhesiveness.

As in the case of Comparative Example 3, when the intermediate layer composed of copper was thick, even if the grain size was adjusted, diffusion of the copper component in the outermost layer was observed to a large extent. As a result, the contact resistance value increased, to result in poor results.

On the other hand, in Comparative Examples 4 and 5, in which the heat treatment temperature was too low or too high, and in which the grain size was smaller than 0.5 μm in both cases, the amount of diffused copper component increased even by controlling the thickness of the intermediate layer to 0.05 to 0.3 μm, and the exposure of copper component to the surface of the outermost layer was increased to increase the contact resistance value, to result in poor results.

Furthermore, in Comparative Examples 6 and 7, the heat treatment was carried out at a temperature of 320° C. for one hour, or at 300° C. for 2 hours, under Ar atmosphere, to enlarge the grain size. Thus, the heat treatment was carried out more than necessary, and as a result, a large amount of copper component was detected at the surface of the outermost layer, to increase the contact resistance value, to result in poor results.

In Conventional Example 1, since the average grain size of the silver or silver alloy in the outermost layer was too large, the resultant sample was poor from the viewpoint of the increased contact resistance value. Conventional Example 1 is a simulation of JP-A-5-002900 (Patent Literature 7).

In Conventional Example 2, since the average grain size of the silver or silver alloy in the outermost layer was too small, the resultant sample was poor from the viewpoint of the increased contact resistance value. Conventional Example 2 is a simulation of Example 5 of JP-A-2005-133169 (Patent Literature 6).

In Conventional Example 3, since the heat treatment time period was too long, and the average grain size of the silver or silver alloy in the outermost layer was too large, the resultant sample was poor from the viewpoint of the increased contact resistance value. Conventional Example 3 is a simulation of Example 6 of JP-A-2005-133169 (Patent Literature 6).

From the above results, it is apparent that the long-term reliability as one of the contact characteristics of movable contact parts can be enhanced, when the grain size of the outermost layer composed of silver or a silver alloy is controlled within the range of 0.5 to 5.0 μm, while the thickness of the intermediate layer is controlled to 0.05 to 0.3 μm, as in the cases of Examples. Furthermore, it can be seen that the grain size can also be controlled by an appropriate heat treatment, and a silver-coated composite material for movable contact parts having both excellent adhesiveness and excellent long-term reliability can be industrially and stably provided.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2010-028703 filed in Japan on Feb. 12, 2010, which is entirely herein incorporated by reference.

| REFERENCE SIGNS LIST | |
|---|---|
| 1 | Dome-shaped movable contact |
| 2 | Fixed contact |
| 3 | Filler |
| 4 | Resin case |

The invention claimed is:

1. A silver-coated composite material for movable contact parts, which has:

an underlying layer composed of any one of nickel, cobalt, a nickel alloy, and a cobalt alloy at least provided on a part of the surface of a stainless steel substrate;

an intermediate layer composed of copper or a copper alloy provided thereon; and a silver or silver alloy layer provided thereon as an outermost layer, wherein a thickness of the underlying layer is 0.01 to 0.2 μm, wherein a thickness of the intermediate layer is 0.05 to 0.3 μm, wherein an average grain size of the silver or silver alloy provided as the outermost layer is 0.5 to 5.0 μm, wherein the outermost layer contains less than 5% of a copper component, and wherein the silver or silver alloy layer provided as an outermost layer comprises silver or silver alloy grains arranged in one layer.

2. The silver-coated composite material for movable contact parts according to claim 1, wherein a thickness of the outermost layer is 0.3 to 2.0 μm.

3. A method of producing a silver-coated composite material for movable contact parts, which comprises the steps of:

providing an underlying layer composed of any one of nickel, cobalt, a nickel alloy, and a cobalt alloy at least on a part of the surface of a stainless steel substrate;

providing an intermediate layer composed of copper or a copper alloy thereon; and providing a silver or silver alloy layer thereon as an outermost layer, wherein a thickness of the underlying layer is 0.01 to 0.2 μm, wherein a thickness of the intermediate layer is 0.05 to 0.3 μm, wherein an average grain size of the silver or silver alloy provided as the outermost layer is made to 0.5 to 5.0 μm, by conducting a heat treatment at a temperature within the range of 50 to 190° C. under an atmosphere of the air, wherein the outermost layer contains less than 5% of a copper component, and wherein the silver or silver alloy layer provided as an outermost layer comprises silver or silver alloy grains arranged in one layer.

4. The method of producing a silver-coated composite material for movable contact parts according to claim 3, wherein the heat treatment is conducted at a temperature within the range of 50 to 100° C. for a time period of 0.1 to 12 hours.

5. The method of producing a silver-coated composite material for movable contact parts according to claim 3, wherein the heat treatment is conducted at a temperature within the range of higher than 100° C. but not higher than 190° C. for a time period of 0.01 to 5 hours.

6. A method of producing a silver-coated composite material for movable contact parts, which comprises the steps of:

providing an underlying layer composed of any one of nickel, cobalt, a nickel alloy, and a cobalt alloy at least on a part of the surface of a stainless steel substrate;

providing an intermediate layer composed of copper or a copper alloy thereon; and providing a silver or silver alloy layer thereon as an outermost layer, wherein a thickness of the underlying layer is 0.01 to 0.2 μm, wherein a thickness of the intermediate layer is 0.05 to 0.3 μm, wherein an average grain size of the silver or silver alloy provided as the outermost layer is made to 0.5 to 5.0 μm, by conducting a heat treatment at a temperature within the range of 50 to 300° C. under a non-oxidative atmosphere, wherein the outermost layer contains less than 5% of a copper component, and wherein the silver or silver alloy layer provided as an outermost layer comprises silver or silver alloy grains arranged in one layer.

7. The method of producing a silver-coated composite material for movable contact parts according to claim 6, wherein the heat treatment is conducted at a temperature within the range of 50 to 100° C. for a time period of 0.1 to 12 hours.

8. The method of producing a silver-coated composite material for movable contact parts according to claim 6, wherein the heat treatment is conducted at a temperature within the range of higher than 100° C. but not higher than 190° C. for a time period of 0.01 to 5 hours.

9. The method of producing a silver-coated composite material for movable contact parts according to claim 6, wherein the heat treatment is conducted at a temperature within the range of higher than 190° C. but not higher than 300° C. for a time period of 0.005 to 1 hour.

10. A movable contact part, formed by working the silver-coated composite material for movable contact parts according to claim 1, wherein a contact portion is formed into a dome shape or a convex shape.

11. A movable contact part, formed by working the silver-coated composite material for movable contact parts according to claim 2, wherein a contact portion is formed into a dome shape or a convex shape.

* * * * *